United States Patent [19]

Lockwood, Jr.

[11] 4,051,682

[45] Oct. 4, 1977

[54] METHOD FOR INSTALLING CEILING PANELS IN A TUNNEL

[76] Inventor: James L. Lockwood, Jr., 10 Tomahawk Road, Hampton, Va. 23669

[21] Appl. No.: 705,612

[22] Filed: July 15, 1976

[51] Int. Cl.[2] ..... E21D 11/05; B25J 3/00

[52] U.S. Cl. ..... 61/45 R; 61/84; 52/480; 214/1 B

[58] Field of Search ..... 61/45 R, 84, 63; 52/480, 745; 214/1 B, 1 S, 1 SW, 1 H, 1 D

[56] References Cited

U.S. PATENT DOCUMENTS

| | | | |
|---|---|---|---|
| 2,455,650 | 12/1948 | Billner | 52/745 X |
| 3,970,200 | 7/1976 | Goetjen | 214/1 H |

FOREIGN PATENT DOCUMENTS

| | | | |
|---|---|---|---|
| 1,271,745 | 7/1968 | Germany | 61/45 |
| 1,234,763 | 6/1971 | United Kingdom | 61/45 |

*Primary Examiner*—Jacob Shapiro

*Attorney, Agent, or Firm*—Schuyler, Birch, Swindler, McKie & Beckett

[57] ABSTRACT

A method for installing ceiling panels in a tunnel comprises installing a plurality of brackets in the tunnel roof and disposing a horizontal platform at an intermediate height in the tunnel. A plurality of ceiling panels are lifted onto the platform where the panels are then linked together to form a ceiling section. The platform is then raised upwardly until the panels are adjacent the brackets, and the panels are then secured to the brackets.

8 Claims, 3 Drawing Figures

METHOD FOR INSTALLING CEILING PANELS IN A TUNNEL

BACKGROUND OF THE INVENTION

1. Field of the Invention

This invention relates to a method for installing panels in a ceiling, and, more particularly, to a method for installing ceiling panels in a tunnel.

2. Description of the Prior Art

It has been customary to utilize a suspended ceiling in tunnels, particularly those used for automobile or other vehicular traffic. Generally, in constructing such a ceiling, the ceiling panels have normally been lifted one at a time and bolted to brackets extending downwardly from the roof. Such a method of construction is very inefficient and time consuming since only one panel is being worked upon at any given time. It takes a large amount of time to complete a tunnel ceiling according to this method thereby necessitating a large number of workers if a construction schedule is to be followed. U.S. Pat. No. 777,013 to A. Fernandez discloses a tunnel having a suspended ceiling.

Various methods for erecting ceilings are known from the prior art. For example, U.S. Pat. Nos. 3,375,795 to Merkle, and 1,824,222 to McLimans, disclose methods for constructing ceilings for furnaces. However, these methods are specifically for use with bricks and are not adaptable to the planar ceiling panels used to form the ceilings in a tunnel. Furthermore, these patents, while associating a plurality of bricks unto a single ceiling panel or section, disclose lifting these sections one at a time to the roof to form the ceiling.

SUMMARY OF THE INVENTION

Accordingly, it is an object of the present invention to overcome the disadvantages of the prior art by providing a method for installing ceiling panels in a tunnel roof wherein a plurality of panels may be placed in the roof at one time.

It is a further object of the present invention to provide a method for installing ceiling panels in a tunnel roof which is very efficient, fast and inexpensive.

Briefly, the present invention accomplishes the foregoing and other objects by providing a method for installing ceiling panels in a tunnel roof which comprises a first step of installing a plurality of downwardly depending brackets in the roof. A horizontal platform is then disposed at an intermediate height in the tunnel. A plurality of panels are lifted upwardly by vacuum lifting attachments to the platform. The vacuum lifting attachments preferably make a plurality of trips a plurality of groups of panels from the ground to the platform. This continues until a sufficient number of panels are arranged on the platform so that a section of the ceiling, preferably spanning the width of the tunnel, is in place on the platform.

At this time, the plurality of panels on the platform are linked together by means of stringers to form a completed section of the ceiling. The platform is then raised upwardly until the stringers which link the panels together are positioned adjacent the brackets. The stringers are then secured to the brackets thereby installing an entire section of the suspended ceiling in the tunnel roof in a single operation.

BRIEF DESCRIPTION OF THE DRAWINGS

The novel features of the invention are set out with particularity in the appended claims, but the invention will be understood more fully and clearly from the following detailed description of the preferred embodiment as set forth in the accompanying drawings in which:

BRIEF DESCRIPTION OF THE PREFERRED EMBODIMENT

Figure 1:
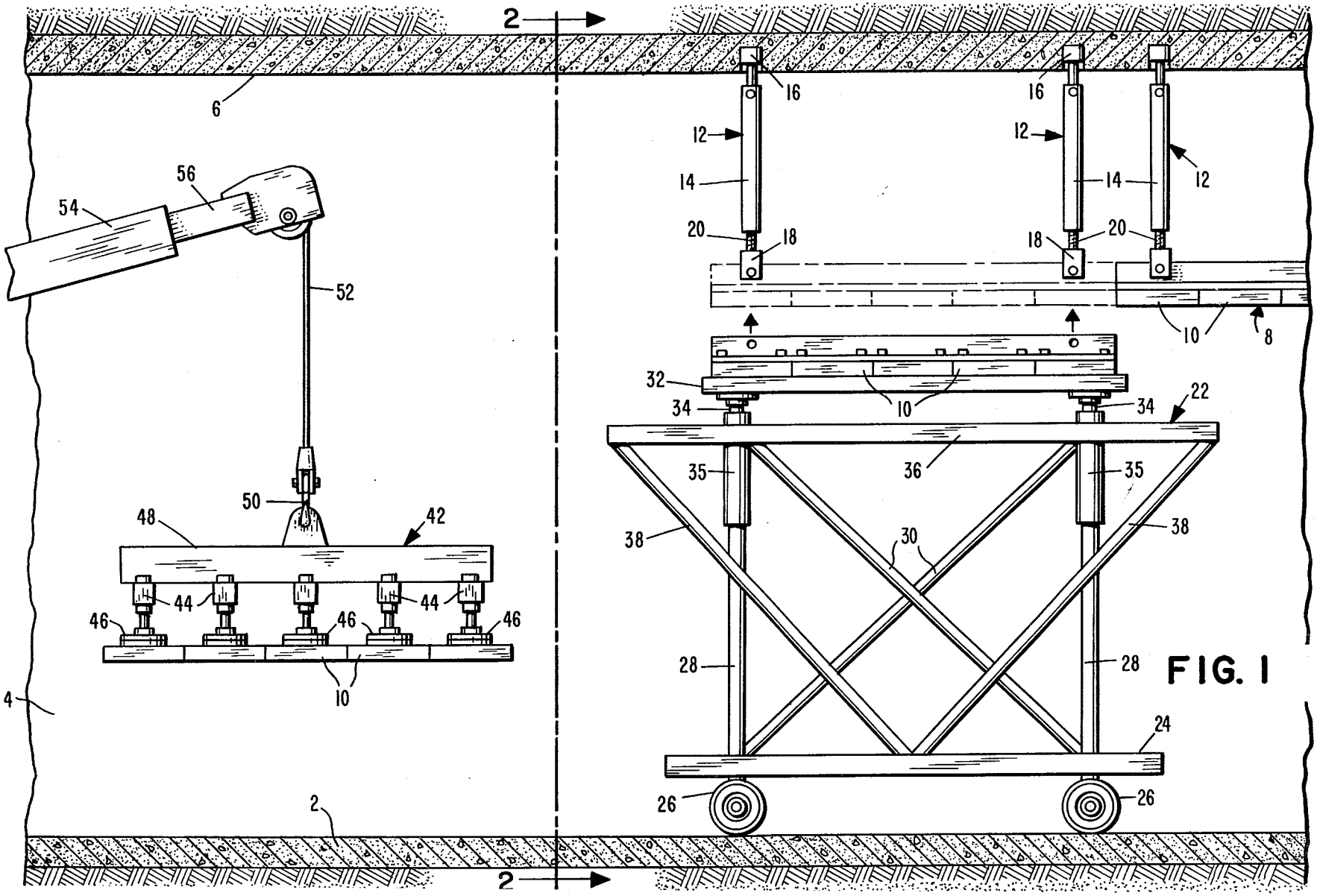
FIG. 1 is a longitudinal cross-sectional view of the method according to the present invention for use in a tunnel.
Figure 2:
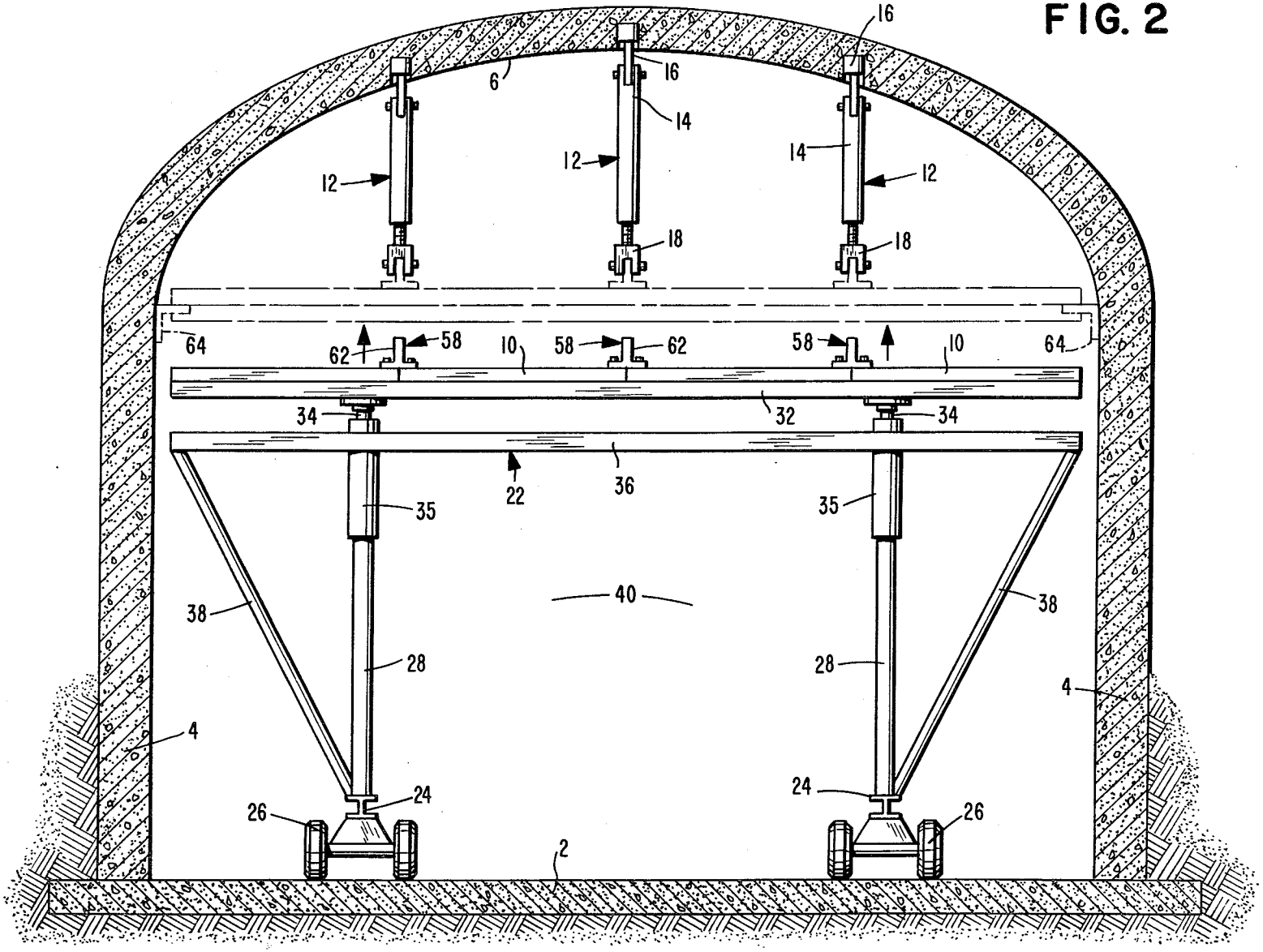
FIG. 2 is a cross-sectional view of the method according to the present invention taken across line 2—2 of FIG. 1.
Figure 3:
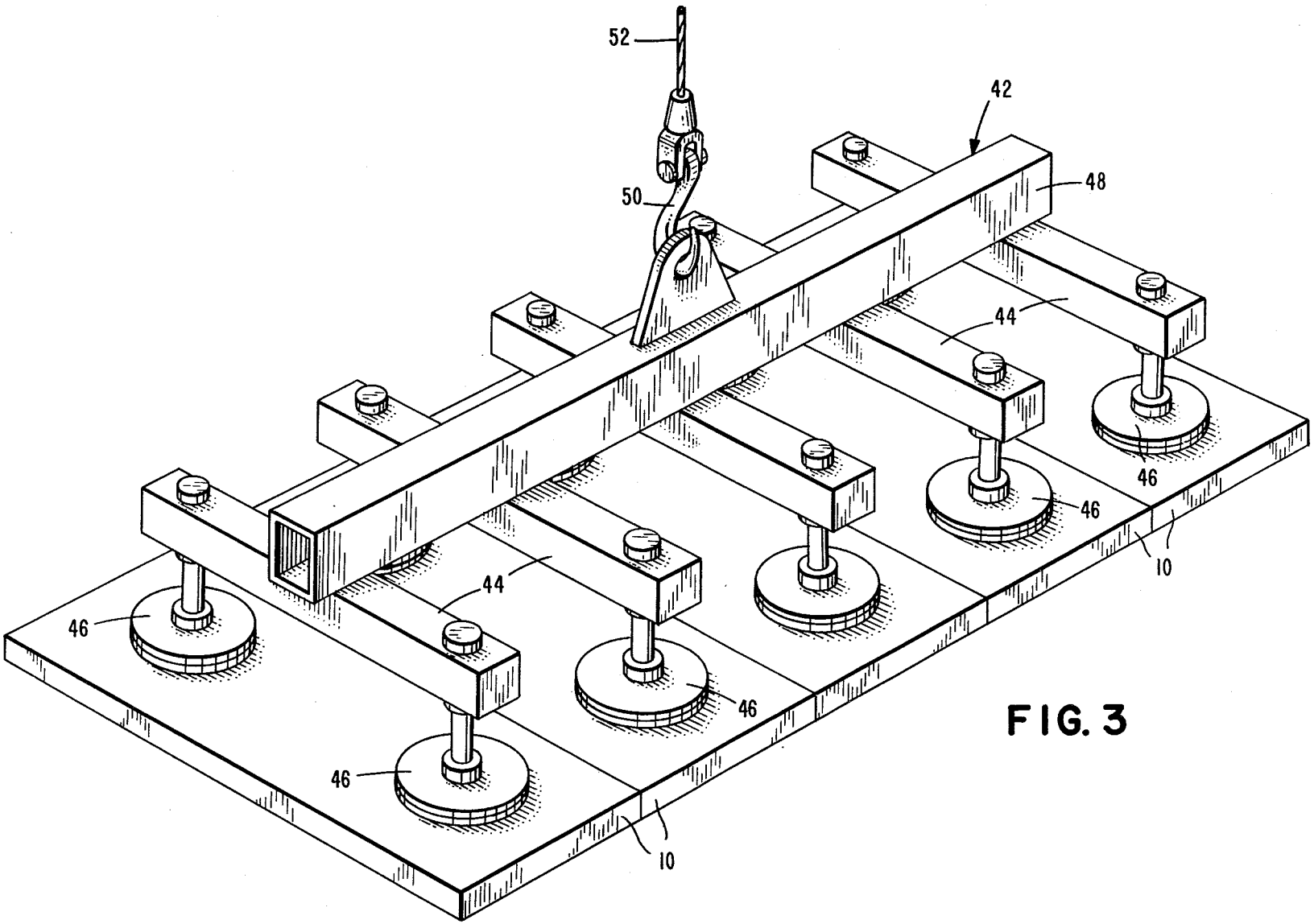
FIG. 3 is a perspective view of a group of ceiling panels being lifted by vacuum lifting attachments according to the method of the present invention.

Referring now to FIGS. 1-3, a typical tunnel is shown having a floor section 2, generally vertical side walls 4 and a domed roof 6. As is customary in tunnels meant for automotive or other vehicular traffic, the floor of the tunnel 2 will receive a suitable roadway (not shown) and the side walls 4 of the tunnel will be tiled or otherwise finished. It is also customary in such tunnels to form a suspended ceiling 8 made up of a plurality of planar ceiling panels 10.

The ceiling 8 is suspended from the tunnel roof 6 by a plurality of brackets 12 which are suitably hung from the roof 6 and depend downwardly therefrom. Each bracket 12 comprises a vertical rod 14 having its upper end pinned to an anchor bolt 16 which is fixed in the tunnel roof 6. The lower end of the rod 14 carries a downwardly oriented U-shaped flange 18 on the end of a threaded shaft 20. As shown in FIGS. 1 and 2, the tunnel roof 6 has three rows of longitudinally spaced brackets 12 across its width. The U-shaped flanges 18 of the brackets 12 may be suitably adjusted by the threaded shafts 20 to a common horizontal level so that the ceiling 8 supported thereby will be horizontal.

A panel support stand 22 is provided inside the tunnel for carrying a plurality of ceiling panels 10 as will be explained more fully hereafter. The base of the stand 22 includes two longitudinal I-beams 24 which are transversely spaced apart. A plurality of wheels 26 are suitably connected to the I-beams 24 so that the stand 22 may be moved along the tunnel to various positions. Four hollow legs 28 are fixed to the I-beams 24 adjacent the ends thereof and extend upwardly from the I-beams 24. A hydraulic cylinder 35 is attached to the upper end of each leg 28 and forms a continuation of the leg 28. Cross braces 30 are connected between the cylinders 35 and the I-beams 24 to reinforce the structure.

The panel support stand 22 further includes a horizontal platform 32, rectangular in shape, having a width equal to the width of four of the ceiling panels 10 and a length equal to the length of five panels. The platform 32 is carried by four rods 34 at each corner thereof which extend downwardly into the open upper ends of the cylinders 35. The end of each rod 34 inside the cylinder 35 comprises the piston rod of the cylinder. The hydraulic cylinders 35 are jointly connected to a pressure source (not shown) to cause the rods 34 to move upwardly and downwardly so that the horizontal platform 32 is vertically movable when the hydraulic cylinders 35 are activated.

The panel support stand 22 additionally includes a catwalk 36 fixed to the legs 28 which extends past the front and rear sides of the horizontal platform 32 so that workmen may stand thereon. The catwalk 36 may be suitably braced by a plurality of rods 38 connected to the I-beams 24. The horizontal platform 32 and catwalk 36 are preferably disposed above the floor 2 of the tunnel at an intermediate height relatively close to the brackets 12. This feature, when coupled with the transversely spaced I-beams 24 and legs 28, leaves a gap 40 in the center of the support stand 22 through which vehicles and workmen may pass to work on other sections of the tunnel. Thus, the panel support stand 22 is utilized in the present invention does not impede work on the tunnel as the ceiling 8 is being formed. However, it should be understood that the stand 22 may be constructed to position the horizontal platform 32 at any desired height in the tunnel.

A lifting means 42 is provided for engaging and handling a plurality of ceiling panels 10. The lifting means 42 includes five vacuum lifting attachments 44, each having two vacuum pads 46, carried by a mounting bar 48. The mounting bar 48 is attached by a hook 50 to the cable 52 of a crane 54 having a telescopable boom 56. The boom 56 may be suitably reciprocated by a fluid power source as is conventional in such cranes. The crane 54 also serves as the source of vacuum power for the pads 46, a flexible hose (not shown) extending from the crane 54 to the vacuum pads 46.

The present invention comprises a method for quickly and easily installing the ceiling panels 10 to the brackets 12 to form the suspended ceiling 8 in the tunnel. The brackets 12 are, of course, first hung or otherwise installed from the tunnel roof 6 by the anchor bolts 16 at suitable positions to receive the ceiling panels 10. At this time, the ceiling panels 10 are normally on the ground arranged in the racks (not shown) in which they were shipped from their place of manufacture. Each rack is adapted to hold one group of ceiling panels 10 comprising a longitudinal row of five panels although the number of panels held in the rack may be varied as desired.

The crane 54 then lowers the vacuum pads 46 into engagement with the five ceiling panels 10 carried in one of the racks. Upon energization of the vacuum, each of the ceiling panels 10 will be adhered to the two vacuum pads 46 as shown in FIG. 3. The crane is then lifted and a single group of five ceiling panels 10 will be lifted upwardly by the vacuum lifting attachments 44. After the crane reaches the height of the platform 32, the movable boom 58 is extended outwardly until the group of panels 10 is located directly above the platform 32. The vacuum in the pads 44 is then shut off thereby depositing the five ceiling panels on the platform 32.

The crane 54 repeats this operation a number of times lifting a plurality of groups of five ceiling panels 10 up to the horizontal platform 32 and arranging them in rows thereon. Where the platform 32 has a transverse width equal to four rows of the ceiling panels 10, the crane 54 will make four trips to the horizontal platform 32 thereby arranging a total of 20 ceiling panels on the platform. At the completion of these trips, the 20 ceiling panels will be suitably positioned underneath the brackets 12 to form a section for the suspended ceiling 8.

After four rows of the ceiling panels 10 have been thus arranged together on the platform 32 by the crane 54, i.e., a total of 20 ceiling panels, workmen, who are standing on the catwalk 36 adjacent the front and rear sides of the horizontal platform 32, may easily link the ceiling panels 10 together by means of longitudinal stringers 58 to form a complete ceiling section. The longitudinal stringers 58 comprise an inverted T-beam which generally extends over the juncture between rows of adjacent panels 10 on the platform 32. Each of the horizontal flanges 60 of the T-beam stringer 58 are bolted to panels 10 in adjacent rows with the vertical flange 62 of the T-beam adapted for later insertion into the downwardly facing U-shaped flanges 18 of the ceiling brackets 12. After all the stringers 58 have been applied to the ceiling panels 10 on the platform 32, the ceiling panels 10 form a completed section for the ceiling 8 as shown in full lines in FIGS. 1 and 2. Although the stringers 58 are preferred in linking the panels 10 together, any other suitable connecting means could also be used.

The horizontal platform 32 is then raised by means of the hydraulic cylinders 35 on the legs 28 until the vertical flange 62 of each of the stringers 58 is positioned inside the U-shaped flange 18 of the corresponding ceiling brackets 12 as shown in the dashed lines in FIGS. 1 and 2. At this point, the workmen, who are still standing on the catwalk 36, may suitably bolt the stringers 58 to the flanges 18 so that an entire section of the ceiling 8 is put into place at once. The edges of those ceiling panels 10 adjacent the tunnel walls 4 may be supported by L-shaped stringers 64, or by any other type of support stringer as necessary.

The present invention thus discloses an improved method for applying planar ceiling panels to form a suspended ceiling in a tunnel wherein a plurality of panels are efficiently linked together at one time to form a section of the ceiling. Although the method of the present invention has been shown for use in a tunnel, it would also be applicable to suspended ceilings generally. Similarly, the number and orientation of the ceiling panels 10 arranged together on the platform 32 to form a ceiling section could obviously be varied as desired. The number of panels lifted by the vacuum lifting attachments 44 to the platform 32 could also be greater or less than the number illustrated herein by adjusting the number of attachments 44 on the mounting bar 48.

Although the present invention has been illustrated in terms of a preferred embodiment, it will be obvious to one of ordinary skill in the art that numerous modifications may be made without departing from the true spirit and scope of the invention which is therefore to be limited only by the appended claims.

I claim:

1. A method for installing ceiling panels in a tunnel comprising the steps of:

a. installing a plurality of depending brackets from the tunnel roof;

b. disposing a vertically movable horizontal platform at an intermediate height in the tunnel;

c. lifting a plurality of separate ceiling panels to said horizontal platform;

d. rigidly linking together said separate panels on said platform to form a single integrated ceiling section for subsequent handling as one unit;

e. raising said horizontal platform to a position adjacent said brackets; and f. securing said ceiling section to said brackets.

2. The method of claim 1 wherein said lifting step comprises successively elevating a plurality of groups of panels from the ground to said platform.

3. The method of claim 2 wherein said lifting step further includes arranging said panels on said platform in rows.

4. The method of claim 1 wherein said lifting step comprises contacting said panels with vacuum means to adhere said panels thereto; and elevating said vacuum means.

5. The method of claim 1 wherein said lifting step comprises successively contacting a plurality of groups of said panels with vacuum means to adhere each said group thereto; and successively elevating each said group from the ground to said platform.

6. The method of claim 1 wherein said raising step comprises moving said platform upwardly by means of hydraulic cylinders.

7. A method for installing ceiling panels in a tunnel comprising the steps of:

a. installing a plurality of depending brackets from the tunnel roof;

b. disposing a horizontal platform at an intermediate height in the tunnel;

c. lifting a plurality of ceiling panels to said horizontal platform wherein said lifting step comprises successively elevating a plurality of groups of panels from the ground to said platform and arranging said panels on said platform in rows.;

d. linking together said panels on said platform to form a ceiling section by applying longitudinal stringers to adjacent rows of said panels along the juncture therebetween;

e. raising said horizontal platform to a position adjacent said brackets; and f. securing said ceiling section to said brackets by attaching said stringers to said brackets.

8. A method for installing ceiling panels in a tunnel comprising the steps of:

a. installing a plurality of depending brackets from the tunnel roof;

b. disposing a horizontal platform at an intermediate height in the tunnel;

c. lifting a plurality of ceiling panels to said horizontal platform;

d. linking together said panels on said platform to form a ceiling section by applying stringers to said panels;

e. raising said horizontal platform to a position adjacent said brackets; and f. securing said ceiling section to said brackets by attaching said stringers to said brackets.

* * * * *